United States Patent [19]

Bacon et al.

[11] 4,432,631

[45] Feb. 21, 1984

[54] PHOTOCONDUCTOR CHARGING TECHNIQUE

[75] Inventors: James L. Bacon, Boulder; Gerald L. Smith, Broomfield, both of Colo.

[73] Assignee: International Business Machines Corporation, Armonk, N.Y.

[21] Appl. No.: 970,587

[22] Filed: Dec. 18, 1978

Related U.S. Application Data

[63] Continuation of Ser. No. 750,800, Dec. 15, 1976, abandoned.

[51] Int. Cl.[3] ..... G03G 15/052

[52] U.S. Cl. ..... 355/3 CH; 355/3 R; 355/3 TR

[58] Field of Search ..... 355/3 CH, 3 R, 3 TR, 355/14 R

[56] References Cited

U.S. PATENT DOCUMENTS 3,609,031 9/1971 Kinoshita ..... 430/55

3,764,207 10/1973 Obuchi ..... 355/3 TR

*Primary Examiner*—Richard L. Moser

*Attorney, Agent, or Firm*—Joscelyn G. Cockburn; Earl C. Hancock

[57] ABSTRACT

In an electrophotographic copying device having charging, imaging, developing, transferring, precleaning and cleaning facilities, the arrangement being in the conventional sense, but incorporates a combined charging and precleaning unit that is operable to perform either a charging function or a precleaning function at the proper time during a copying/cleaning cycle. A combined precharging/transferring unit is also incorporated to facilitate precharging or transferring at a predetermined time during the copying process.

26 Claims, 4 Drawing Figures

CYCLE 1

CYCLE 2

PHOTOCONDUCTOR CHARGING TECHNIQUE

CROSS REFERENCES TO RELATED APPLICATION

This is a continuation, of application Ser. No. 750,800 filed Dec. 15, 1976, now abandoned, which is a continuation-in-part of application Ser. No. 580,643, filed May 27, 1975, now abandoned.

BACKGROUND OF THE INVENTION

1. Field of the Invention

The invention relates to an electrophotographic copying device and more specifically, to an improvement over the charging and cleaning of the support surface on which the latent image of an original is developed.

2. Prior Art

The following U.S. Patents are representative of the prior art: U.S. Pat. Nos. 3,647,293; 3,637,306; and 3,736,055.

Numerous prior art teachings in the field of electrophotographic or xerographic copying teaches various methods and devices for preparing the surface of a photoconductor so as to obtain a latent image from an original copy. Prints are then transferred from the latent image on the surface of the photoconductor, to a transferring media.

To enable the development of the latent image on the photoconductor and the transferring of said latent image to a transferring media, several stations are arranged in proximity to and to cooperate with the photoconductor to perform certain functions. At the charging station, the photoconductor is charged negatively. The photoconductor then moves to the exposing or imaging station where a latent image is copied from an original. Next, the electrostatic latent image is developed at a developer station to form a toner image on the photoconductor. The toner image is then transferred from the photoconductor to another media at the transferring station. To complete the cycle, the photoconductor is erased, precleaned, and cleaned and is then ready for another cycle.

Although the prior art electrophotographic devices function adequately for the intended purpose, several problems plague the systems.

Probably one of the pressing problems is the fact that the charging, transferring and precleaning functions are all performed by separate coronas at separate stations. With this type of prior art design, the cost of the electrophotographic device is relatively high, due to the individual cost of each corona. Since the general trend is to minimize the cost of electrophotographic devices without sacrificing efficiency, any reduction in the number of component counts in the prior art devices will be welcomed.

Another problem relating to the separate processing station is the fact that each of the separate coronas requires a separate power supply. The aggregate cost of these power supplies further augments the overall cost of the unit. As such, any reduction in the number of power supplies will result in cost reduction of the unit.

It is common knowledge that conventional electrophotographic devices may be either a single cycle process or a two cycle process. In the typical two cycle process, the photoconductor is charged, imaged and developed during the first cycle; while the image is transferred and the photoconductor is cleaned in the second cycle. For satisfactory operations, some of the stations which render necessary functions during the copying process are active during the first cycle, while others are inactive and vice versa. On account of the rapid speed at which the photoconductor accesses each of the stations. It is, therefore, necessary for high speed switching to occur at these stations. The conventional 60 cycle power supply which is used for supplying power to these stations cannot withstand high speed switching. With these drawbacks, it is clear that a more efficient device is needed.

Several attempts have been made to improve the prior art electrophotographic devices by solving some of the above identified problems. For example, attempts have been made to combine the charge and the transfer corona stations. At first blush, this combination seems to be workable and logical; since the function of both stations is to supply negative charges. However, the combination instead of solving the above described problems creates additional problems.

One of the additional problems stems from the fact that the combined charge transfer station is designed with a grid structure to enhance the charge operation. However, transferring media which is fed into the machine at the charge/transfer station for transferring the latent image from the photoconductor jams into the grid wires. This jam results in machine breakdown.

For proper operation, a negative charge has to be deposited onto the transferring media so that the positively charged toner particles will be attracted. With the presence of the grid assembly in the combined charge/transfer station, the negative charge cannot be uniformly distributed onto the transfer media. With an uneven distribution of charges, the quality of the final copy is less than satisfactory.

OBJECTS OF THE INVENTION

It is, therefore, the object of the invention to design a more efficient, low cost electrophotographic device than has heretofor been possible.

It is another object of the present invention to build an electrophotographic device with fewer coronas than has heretofor been possible.

It is a further object of this invention to combine the preclean and charge coronas into a single unit.

It is still a further object of the present invention to use the transfer corona station to render the precharging and the transferring functions.

SUMMARY OF THE INVENTION

The present invention overcomes the aforementioned drawbacks in the prior art by means of a unique structural combination of processing stations within the copying process. More specifically, the invention discloses a unique two cycle process for an electrophotographic copying device. In one feature of the invention during the first cycle, the photoconductor is overcharged to a first polarity by the combined precharge transfer corona (Corotron), the overcharge is then reduced by an opposite polarity combined charge/precleaned corona (Scorotron). Imaging and developing also occurs during this first cycle.

During the second cycle, the toned image is transferred to the transferring media using the same precharge transfer corona (Corotron). Following transfer, the drum is charged by the charge/preclean corona to a second potential for cleaning. In order to place the second charge level or potential on the photoconductor drum, the grid of the charge/preclean corona is switched to a different voltage (either the same or opposite polarity or ground as required to obtain heat cleaning). The drum is then (optionally) erased by the erase lamp, and cleaned by the developer.

In another feature of the invention, the photoconductor is overcharged by a first or auxilliary corona which may (optionally) have a grid for smoother precharging, at a precharge station. This first or auxilliary corona is separate and distinct from the final charge/preclean corona and the overcharge/transfer corona. The charge is then reduced to a uniform value by a second corona of opposite polarity at a final charge station. The photoconductor is then ready for imaging and developing. In this embodiment the system is characterized as a three (3) corona overcharge system.

In another feature of the invention, the photoconductor is charged to a very uniform negative value from the precharge level by means of a positive final charge corona which yields more uniform emission than a negative corona.

Another feature of the invention is the use of a gridded corona (Scorotron) to perform the preclean function. The increased control of the preclean photoconductor voltage, because of the grid structure, may eliminate the need for the preclean erase lamp function. The improved cleaning action has reduced the hole and electron carrier intensities in the photoconductor which also reduces the fatigue effects of the photoconductor.

The foregoing and other objects, features and advantages of the invention will be apparent from the following more particular description of the preferred embodiment of the invention, as illustrated in the accompanying drawings.

DETAILED DESCRIPTION

Figure 1:
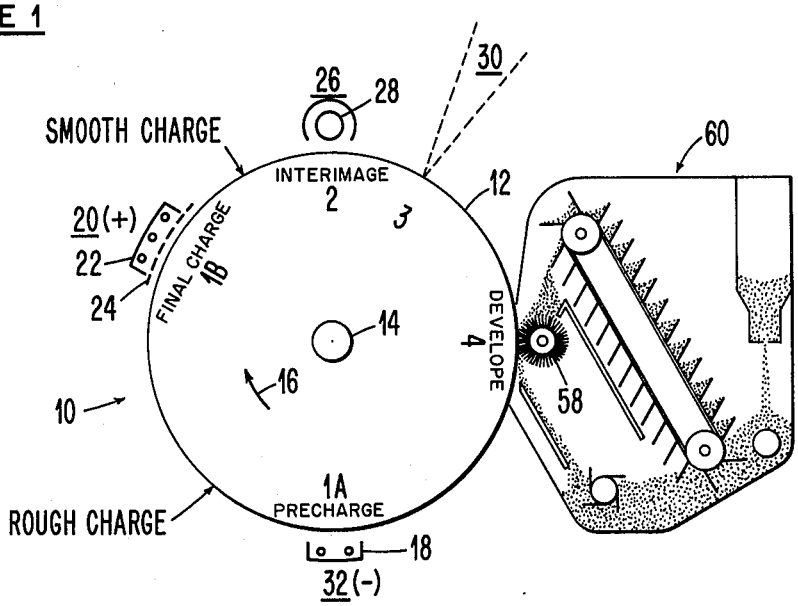
FIGS. 1 and 3 are a schematic diagram of a two cycle process electrophotographic machine showing a plurality of processing stations which incorporates the present invention.

The term corotron as used in this application means a type of corona having either limited or no grid structure. In effect the corotron may be considered analogous to a current source.

The term scrotron as used in this application means a type of corona having a grid structure. The scorotron may be considered as a voltage source.

For explanation purposes, the photoconductor in the preferred embodiment of the present invention will be described as a rotating drum. However, this should not be construed as a limitation on the scope of the invention; since it is well known in the art to design a photoconductor having a different shape, size and mechanical configuration. For example, the photoconductor may be a continuous belt or a plate rather than a rotating drum structure.

Although the preferred embodiment of the invention is described in association with a two cycle copying process, this should be interpreted as only illustrative rather than restrictive, since it would be obvious for one skilled in the art to modify the inventive feature as disclosed hereinafter to make said concept operable in a one cycle copying process. In the drawings, similar elements are identified by identical numerals.

Figure 3:
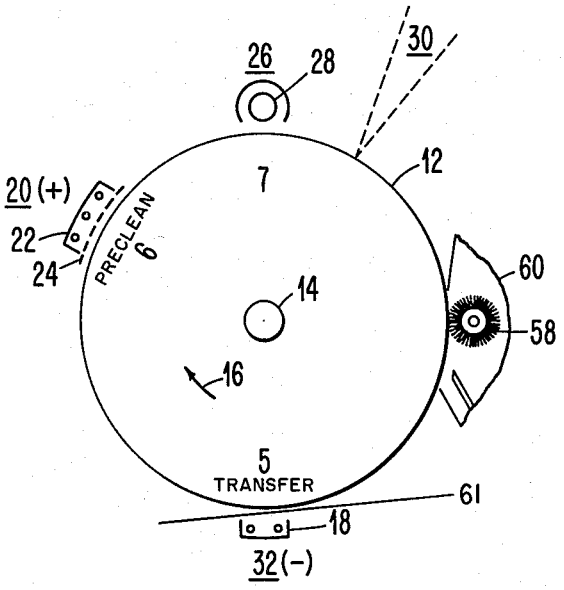

Referring now to FIG. 1 and FIG. 3, a pictorial view of an electrophotographic copying system 10 which embodies the present invention is shown. A cylindrical drum 12, hereinafter called a photoconductor, is mounted for rotation on shaft 14 and having on its outer periphery a photoconductive insulating layer which contains an organic or inorganic photoconductor material. The drum 12 is rotated to bring the photoconductive layer in space relationship with various stations associated with the electrophotographic process; each of said stations being positioned in proximity to the rotating drum.

A negative corotron 18 is positioned within the orbit of cylindrical drum 12 to define the so called precharge/transfer station 32. Negative corotron 18 of the precharge/transfer station serves two functions, namely: to deposit an excess of negative ions on the surface of the photoconductor (for example, −1300 volts) and to deposit negative ions on a transferring media, for example, paper so as to transfer a latent toner image from the surface of the photoconductor. As will be explained subsequently, the negative charge which is deposited to the photoconductor by negative corotron 18 is rough; i.e., the charge is unevenly distributed on the surface of the photoconductor.

After precharge/transfer station 32, the next station in order is the combined final charge/preclean station 20. Final charge/preclean station 20 is the facility which supplies the final charge to the surface of the photoconductor and renders the preclean function. This final charge is referred to as smooth due to the fact that the charge is evenly distributed over the surface of the photoconductor because of the cutoff characteristic produced by the control grid 24. As will be explained subsequently, the polarity of the emission wires in the final charge/preclean corona is opposite to the voltage applied by the precharge/transfer corona. In the preferred embodiment, a positive emission voltage is used so that positive ions are generated.

Final charge/preclean station 20 comprises a positive scrotron 22. Scrotron 22 supplies positive ions at station 20. The positive ions reduce the rough charge on the photoconductor surface to a smooth charge. Grid structure 24 is positioned between scrotron 23 and the photoconductor 12. The function of grid structure 24 is to control the flow of positive ions which are deposited on photoconductor 12 and hence, the resulting smooth photoconductor voltage.

Figure 2:
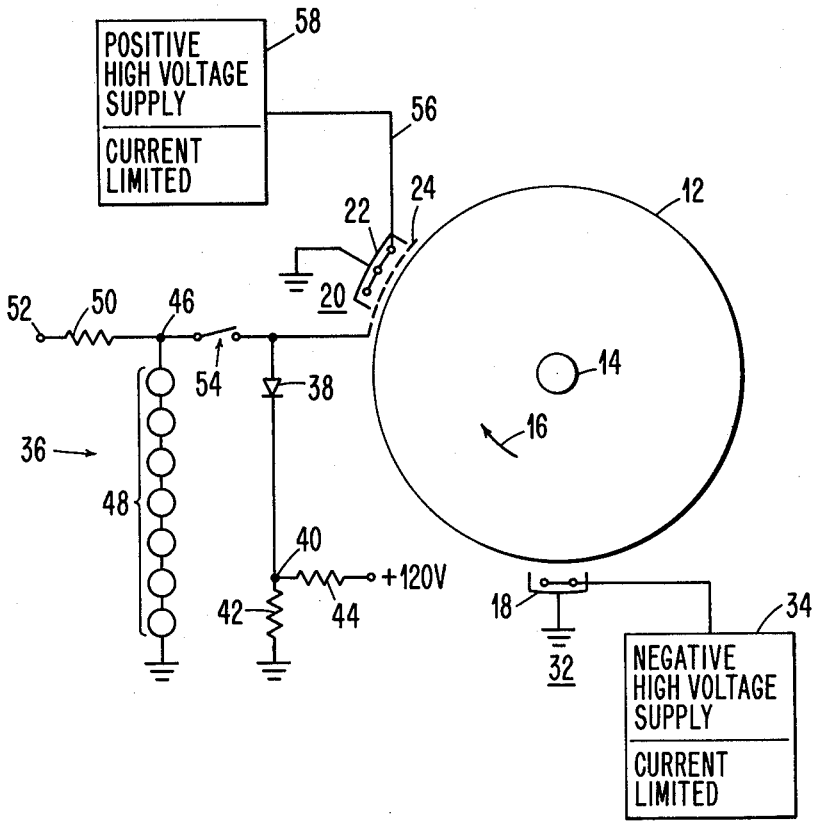
FIG. 2 is a schematic diagram showing the control circuit which changes the voltage of the control grid in the combined charge/preclean station.

As will be explained subsequently, and as shown in FIG. 2, a switching circuit is connected to grid 24 to control the voltage on the grid. For example, in one instance the voltage on the grid is very negative (approximately-700 volts), while in another instance the grid is slightly positive (approximately +50 volts). Still in another instance, the voltage may be slightly negative (approximately −50 volts) or ground.

The other station in order is the so called interimage station 26. The interimage station comprises high intensity lamp 20 and the function is to erase images on the sides of the photoconductor depending on the size of the document to be copied. During the second cycle, this lamp can be optionally turned on to erase the photoconductor and, therefore, aids in the cleaning process of said photoconductor.

The next station in order is the image station 30. Image station 30 comprises a conventional optical system which functions to transfer a latent image of a document onto the photoconductor. With the latent image on the photoconductor, the most station in line is the developer cleaner station 60. Developer cleaner station 60 is conventional. For example, the developer cleaner station is analogous to the developer cleaner station as disclosed in the above identified U.S. Pat. No. 3,637,906, entitled "Copying System Featuring Alternate Developing and Cleaning of Successive Image Areas for Photoconductor" and assigned to the same assignee of the present invention.

Referring now to FIG. 2, the control means which controls the negative corotron 18 of precharged station 32 is disclosed. Also the control means for switching the polarity of grid structure 24 from a first potential to a second potential is disclosed.

Figure 4:
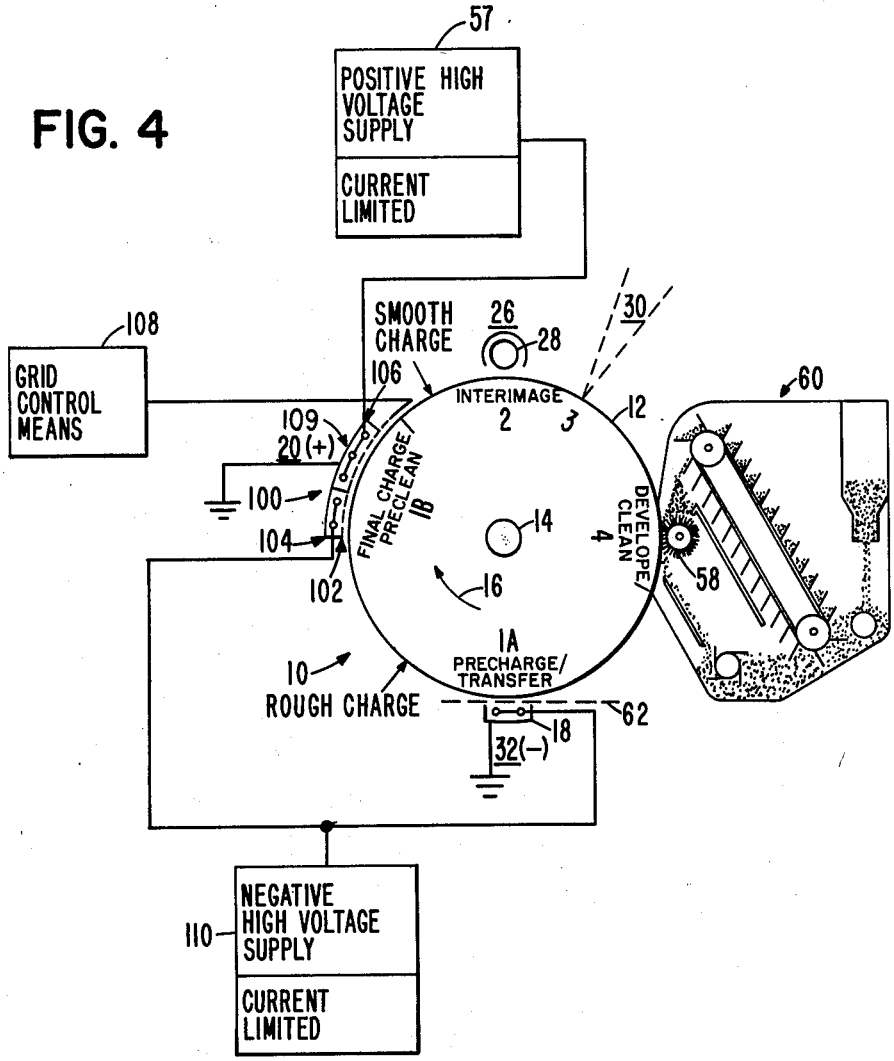
FIG. 4 shows an alternative embodiment of the invention in which the final charge/preclean function is rendered by a Dual Bay Corona. The Dual Bay Corona is controlled by a common grid.

As was mentioned previously, negative corotron 18 of precharge/transfer station 32 supplies negative ions to the photoconductor in one cycle and in another cycle supplies negative ions to a transfer medium 62 (FIG. 4). In order to supply negative ions, a negative high voltage power supply 34, also called control means 34, is connected to corotron 18.

In one embodiment of precharge/transfer station 32, the same amount of negative ions (negative charge) is applied to the photoconductor and the transfer media. With this design there is no need for a switching mechanism to switch the control means 34 so as to supply different current levels to corotron 18. In an alternative embodiment, the magnitude of the negative charge which is applied to the photoconductor and the transfer media is different. This design requires a switching means analogous to the one which will be subsequently described.

Still referring to FIG. 2, grid structure 24, also called control means 24, functions as a limiting means for controlling the positive ion (positive charge) which is deposited on the surface of photoconductor 12 from scorotron 22. The resulting photoconductor voltage is a function of the grid voltage. In order to effectuate this limiting or controlling function, a switching means is operably connected to the grid for switching its voltage between two (or more) levels.

Switching means 36 comprises a diode 38 hereinafter called unidirectional device 38. One terminal of the unidirectional device is connected to grid 24 while the other terminal is connected to positive terminal 40 hereinafter called third reference voltage source 40. Third reference voltage source 40 may be any positive value, negative value or ground. For example, in the preferred embodiment of this invention the value was ground.

Resistor 42, hereinafter called third resistor means 42 connects third reference voltage source 40 to a lower or equal potential. In the preferred embodiment of this invention, the low potential is ground. Likewise, another resistor 44, hereinafter called second resistor means 44, connects third reference voltage means 40 to a higher potential. In the preferred embodiment of the invention, the higher potential was chosen to be 120 volts.

In an alternate embodiment of the invention, third reference voltage source 40 is connected to a switchable preclean level supply. The preclean level supply can be adjusted to one of a plurality of voltage potentials. For example, typical voltage levels would be +100 volts to −100 volts or ground.

Reference voltage source 46, hereinafter called first reference voltage source 46, is positioned in parallel with third reference voltage source 40. The potential of first reference voltage source 46 is negative. In the preferred embodiment of this invention, a 1000 volts negative potential was chosen. First reference voltage source 46 was established by a conventional bank of neon tubes 48. Of course, it would be obvious to one skilled in the art to substitute conventional devices to establish first reference voltage source 46 without departing from the scope of this invention.

Resistor 50, hereinafter called first resistor means 50, is connected in series with first reference voltage source 46 so as to establish second voltage source 52. In the preferred embodiment of this invention, source 52 is chosen to be 1500 volts negative. In an alternate embodiment, second voltage source 52 was connected to a negative grid supply means. The negative grid supply means has a typical value of approximately −1500 volts. Switching means 54 interconnects unidirectional device 38 and first reference voltage source 46. The connection is such that by activating switching means 54 either the voltage at third reference voltage source 40 or the voltage at first reference voltage means 46 is rendered operative (that is, appears on grid 24). Of course, several conventional switching devices may be used for switching means 54. However, in the preferred embodiment of this invention, switching means 54 was a high voltage read relay switch. Positive high voltage supply 58 supplies power to scorotron 22 via terminal 56.

In the preferred embodiment, high voltage corona supplies 34 and 58 are current regulated so that they deliver a constant total current to the corona emission wires.

Referring now to FIG. 4 an alternative preferred embodiment of the invention is shown. In this preferred embodiment both the final charge and the preclean function are performed by dual bay corona charging station 100 with a common grid 102. As mentioned before the electrophotographic copying system 10 includes photoconductor 12 which is rotated on shaft 14 to position the photoconductive insulating layer in space relationship with various stations associated with the electrophotographic process and positioned in proximity to the photoconductor.

As photoconductor 12 rotates clockwise in the direction shown by arrow 16, it encounters precharge/transfer station 32. Precharge/transfer station 32 includes negative corotron 18. Negative corotron 10 performs two functions. During the first cycle of the two cycle process, negative corotron 18 charges the photoconductor to a negative voltage polarity. This negative voltage polarity may be less than the voltage which has to be placed on the photoconductive drum for satisfactory operation (or may be zero if the corona is turned off during this cycle). For example, in the preferred embodiment a negative charge of minus 800 volts is placed on the photoconductive surface. Of course, it is within the skill of the art and the teaching of this invention to vary the voltage both in magnitude and polarity without departing from the scope of this invention.

During the second cycle of the two cycle process, negative corotron 18 charges transfer media which is supplied along paper path 62 to an acceptable voltage level so that latent image which is developed as the photoconductive surface of photoconductor 12 is transferred to said transfer means. In this embodiment of the invention negative corotron 18 is set at one voltage level as opposed to switching the voltage level of corotron 18 relative to whether the surface of the photoconductor or the transfer media is being charged. Stated another way, in the embodiment stated above, if corotron 18 is charging the photoconductor surface, the magnitude of the voltage is set at one level. Alternately, if corotron 18 is charging transfer media which is supplied along paper path 62, then the emission voltage from corotron 18 is set at a second level, generally less than the first level. For satisfactory operation, high frequency power supply is required, since the conventional 60 cycle power supply is not easily switched. However, with the alternative embodiment depicted in FIG. 4, corotron 18 may be set at one current level. Generally, the setting is dictated by the voltage level which has to be placed on the transfer media which is supplied along paper path 62.

Positioned downstream from the precharge transfer station is the dual bay corona charging station 100. Dual bay corona charging station 100 performs two functions, namely to smooth and increase the negative charge which is deposited on photoconductor 12 by negative corotron 18 (or to do the total precharge function if the transfer corona 18 is turned off during this cycle) and to deposit a charge on the photoconductor which precleans the photoconductive surface. The smoothing function occurs during the first cycle of the two cycle process while the preclean function occurs during the second cycle of the the two cycle process. The dual bay corona of charging/preclean station 100 includes a leading bay 104 and a trailing bay 106. The small leading bay is negative and supplies negative ion to the photoconductive surface while the trailing bay supplies positive ions to the photoconductive surface. Of course, this arrangement can be changed without departing from the scope of the present invention. The emission from the leading bay and the trailing bay is controlled by common grid structure 102. Common grid structure 102 is tied to grid control means 108. Several conventional grid control means can be used to switch the voltage on the grid. For example, the switching means previously described above is one of the many configurations which may be used.

The physical design of dual bay corona charging station 100 can take several forms. For example, as is shown in FIG. 4 a common case 109 can be used to form a uniform structure having the two bays. Alternately, the dual bay corona charging station 100 may be separate coronas having separate grounding case and separate grids and grid supplies. However, irrespective of what configuration is used, grid 102 is common to both the positive and negative coronasof charging/preclean station 100. Still referring to FIG. 4 the emission wires of leading bay 104 and the emission wire of negative corotron 18 is tied in parallel to a negative high voltage supply 110. Assume that a negative charge having a magnitude of minus 800 volts is placed on the photoconductor by precharge transfer station 32. As the conductive surface approaches leading bay 104, negative ions are supplied from the leading bay of the dual bay corona charging station 100. This negative ion augments the negative charge which was previously deposited on the photoconductive surface and increased said charge to an approximate value of minus 1100 volts. As the photoconductor approaches trailing bay 106 of dual bay corona charging station 100, positive ions are emitted which further smooth the charge to a voltage level which is acceptable to perform the electrophotographic process. For example, the charge is neutralized to minus 870 volts. During this process, common control grid 102 is tied at the approximate voltage of minus 1000 volts by grid control means 108. The magnitude of the voltages are only descriptive and does not limit the scope of this invention.

Positioned downstream from dual bay corona charging station 100 is the interimage erase station 26. Interimage erase station 26 includes erase lamp 28. Erase lamp 28 discharges the border area or no copy area of the photoconductor to approximately minus 150 volts.

Positioned downstream and in order is the illumination station 30 and the developing cleaning station 60. These stations have already been described above and will not be described in any detail here. Suffice it to say that at station 30 the photoconductor is selectively discharged in accordance with the document to be copied. While at station 60 the latent image which is placed on the photoconductor surface is toned and subsequently the photoconductor surface is cleaned. This completes the detailed description of the preferred embodiment of the invention.

OPERATION

In describing the operation of the two cycle process, the position of the processing station in relation with rotating cylindrical drum 12 will be equated with positions on the face of a clock (see FIGS. 1 and 3). In operation, cylindrical drum 12 rotates in the direction shown by arrow 16. During the first cycle of the two cycle process (FIG. 1), step 1A occurs at 6:00. At 6:00, the precharge/transfer constant current negative corona 18 of precharge/transfer station 32 will precharge the photoconductor of cylindrical drum 12 to a rough negative voltage. For example, the overcharge voltage is −1300 volts.

The second step 1B occurs at 11:00 where the final charge/preclean scorotron 22 of final charge/preclean station 20 reduces the photoconductor charge to approximately −800 volts as controlled by grid 24. At 12:00 step 2 occurs; lamp 28 of interimage station 26 performs the interimage erase. At 1:00, step 3 occurs; the photoconductor is imaged at image station 30, such that the photoconductor charge in a black image is approximately −720 volts, the photoconductor charge in a gray image is approximately −400 volts, and the erase background and white charge is from −170 to −200 volts.

At approximately 4:00 step 4 occurs; the latent image is developed by magnetic brush 58 of developer/cleaner station 60. The bias of magnetic brush 58 is approximately −300 volts. Thus, magnetic brush 58 is positive relative to the latent image and negative relative to the erased background. This completes the first drum cycle.

At 6:00 during the second drum cycle (FIG. 3), step 5 occurs; transfer media 62 is gated so that it moves between the corona and the drum. Negative corotron 18 of precharge/transfer station 32 provides the electrostatic force causing the toned image on cylindrical drum 12 to be transferred to transfer media 61. The transfer media, for example, paper, is held against drum 12 by electrostatic force only. In one embodiment of the invention, the same corotron current setting was used for both precharge and transfer functions so that switching the current level was not necessary except at the end of a multicopy run when the unit must be turned off for the final clean cycle. Of course, one alternative embodiment would be to switch the current setting depending on whether the precharge function or the transfer function was being performed.

At approximately 11:00 during the second drum cycle step 6 occurs; switching means 36 (FIG. 2), switches grid 24 so that the voltage from third reference source 40 appears on the photoconductor surface of rotating drum 12 so that the charge on said drum is reduced to a voltage near ground. This change in voltage accomplishes the preclean function.

At approximately 12:00 step 7 occurs; lamp 28 of interimage station 26 is energized to illuminate the entire photoconductor surface of rotating drum 12 which changes the voltage to approximately 0 volts. This is an optional step and may be eliminated because of the improved control of the preclean photoconductor voltage achieved with gridded preclean corona. At 1:00 during the second cycle, imaging station 30 may be on or off. The photoconductor then rotates to developer/-cleaner station 60 where magnetic brush 58 removes residual toner from the photoconductor surface. This completes the two cycle process.

This unique configuration as described above has distinct advantages over prior art configurations, in that the requirement of high voltage ferro switching in short time intervals is eliminated. In addition, the combination of the two corona units requires one less power supply and one less corona unit for a sizable cost reduction.

Another advantage of this configuration is the fact that the transfer corona can be made smaller than would have been possible if the combined charge and transfer coronas had been used. This is important in that significant reduction in the overall machine dimension is achieved.

While the invention has been particularly shown and described with reference to a preferred embodiment thereof, it will be understood by those skilled in the art that various changes in form and details may be made therein without departing from the spirit and scope of the invention.

What is claimed is:

1. In a two cycle process, electrophotographic apparatus having a photoconductor with the customary electrophotographic facilities for charging, imaging, developing, transferring and cleaning, the improvement comprising:

a first generator means with a first polarity being positioned in proximity with the photoconductor defining a combined precharge/transfer station;

second generator means with an opposite polarity being positioned in proximity with the photoconductor and downstream from the first generator means for defining a combined final charge/preclean station;

switching means operably associated with said second generator means for controlling the second generator means so as to generate different voltage levels to preclean or final charge the photoconductor.

2. The device as claimed in claim 1 further including a first power source for supplying negative power to the first generator means.

3. The device as claimed in claim 2 further including a second power source for supplying positive power to the second generator means.

4. The apparatus as claimed in claim 1 wherein the first generator means is a negative corona generating negative charges for precharging the surface of the photoconductor during a first cycle of the copying process.

5. The device as claimed in claim 1 wherein the second generator means comprises:

a positive corona;

a control grid structure being positioned between the positive corona and the photoconductor, the combined corona and grid structure function so as to charge the photoconductor to a final charge during the first cycle of the copying process and to clean the photoconductor during the second cycle of the copying process.

6. The device as claimed in claim 1 wherein the switching means comprises:

a first reference voltage source;

a first resistor means being connected in series with the first voltage source to establish a second voltage source;

a third reference voltage source, positioned in parallel with the first reference source, having a polarity opposite to that of the first reference source;

a second resistor means interconnected to said third reference voltage source so as to create a voltage drop between the third reference voltage source and a higher voltage supply source;

a third resistor means interconnected to said third reference source and a lower potential source;

a unidirectional device connected to said third reference voltage source; and a switching means interconnecting the unidirectional device and the first reference voltage source so that by activating said switching means either the third reference voltage source or the first reference voltage source is rendered functional.

7. The device as claimed in claim 6 wherein the unidirectional device is a diode.

8. An electrostatic copying apparatus according to claim 4 wherein the development cleaning combination unit comprises a magnetic roller disposed adjacent to the photosensitive layer of the rotatable drum to form a magnetic brush, and impressed with a bias voltage having an absolute value less than a voltage on the photosensitive layer in the development step and with an absolute value greater than the voltage on the photosensitive layer in the cleaning step.

9. In a two cycle process electrophotographic apparatus having a photoconductor with the customary electrophotographic facilities for charging, imaging, developing, transferring and cleaning, the improvement comprising:

a first generator means with a first polarity being positioned in proximity with the photoconductor defining a combined precharge/transfer station; said first generator means being a negative corona generating a first charge for precharging the surface of the photoconductor during a first cycle of the copying process and generating a second charge for charging a transfer media during a second cycle to transfer latent image from the photoconductor to the said transfer media, first power source for supplying negative power to the first generator means;

second generator means with an opposite polarity being positioned in proximity with the photoconductor and downstream from the first generator means for defining a combined final charge/preclean station;

switching means operably associated with said second generator means for switching the second generator means to different voltage levels so as to preclean or final charge the photoconductor.

10. An electrostatic copying apparatus according to claim 8 wherein the development cleaning combination unit comprises a magnetic roller disposed adjacent to the photosensitive layer of the rotatable drum to form a magnetic brush, and impressed with a bias voltage having an absolute value less than a voltage on the photosensitive layer in the development step and with an absolute value greater than the voltage on the photosensitive layer in the cleaning step.

11. In a two cycle process electrophotographic apparatus having a photoconductor with the customary electrophotographic facilities for charging, imaging, developing, transferring and cleaning, the improvement comprising:

a first generator means with a first polarity being positioned in proximity with the photoconductor defining a combined precharge/transfer station;

second generator means with an opposite polarity being positioned in proximity with the photoconductor and downstream from the first generator means for defining a combined final charge/preclean station;

said second generator means having a positive corona with a control grid structure being positioned between the positive corona and the photoconductor, the combined corona and grid structure function to charge the photoconductor to a first final charge voltage during the first cycle of the copying process and to a second preclean charge voltage during the second cycle, said second preclean charge voltage being of opposite polarity to the polarity of the first final charge voltage which was being placed on the photoconductor during the first cycle; and switching means operably associated with said second generator means for switching the second generator means to different voltage levels so as to preclean or final charge the photoconductor.

12. The device as claimed in claim 11 wherein the magnitude of the second preclean charge voltage is different from the magnitude of the first final charge voltage.

13. In a two cycle process electrophotographic copying apparatus wherein a photoconductor is charged, imaged, developed, transferred and cleaned, the improvement comprising:

a combined precharge/transfer generator for supplying a first charge to the photoconductor;

first voltage means operably connected to said precharge/transfer generator for charging said photoconductor to a first voltage level during the first cycle of the process and for charging a transfer media to a second voltage level during the second cycle of the process;

a combined final charge/preclean generator for supplying a second charge to the photoconductor;

second voltage means operably associated to the final charge/preclean generator for supplying a predetermined charge; and means operably associated with the final charge/preclean generator for controlling the voltage on the photoconductor surface.

14. In an electrophotographic copying apparatus wherein a photoconductor is charged, imaged, developed, transferred and cleaned, the improvement comprising:

a first electrostatic generator of a first polarity cooperating with said photoconductor to define a precharge/transfer station;

a second electrostatic generator of an opposite polarity cooperating with said photoconductor to define a final charge/preclean charge station at a position downstream from said precharge/transfer station;

imaging means cooperating with said photoconductor to define an imaging station at a position downstream from said final charge/preclean charge station;

said imaging means being operable to form a latent electrostatic image of said first polarity as said photoconductor passes said imaging station;

a magnetic brush developer providing toner of said opposite polarity and cooperating with said photoconductor to define a developing/cleaning station at a position downstream from said imaging station;

control means associated with said precharge/transfer station, operable during a first cycle of said photoconductor to deposit a charge of said first polarity on said photoconductor as it passes said precharge/transfer station;

said control means operable during a second cycle of said photoconductor to charge a transfer medium to said first polarity to effect transfer of said toner thereto as said photoconductor passes said precharge/transfer station;

control means associated with said final charge/preclean station being operable during a first cycle to thereafter reduce the charge of said first polarity of a lower magnitude as said photoconductor passes said final charge/preclean charge station;

said control means being operable during a second cycle to thereafter subject said photoconductor and residual toner to a cleaning charge of said opposite polarity as said photoconductor passes said final charge/preclean charge station; and means to thereafter clean the residual toner from said photoconductor as said photoconductor passes said developing/cleaning station during said second cycle.

15. A two cycle process electrophotographic apparatus having a photoconductor which is charged, imaged, developed during a first cycle, transferred and cleaned during a second cycle, the improvement comprising:

a first generator means positioned in proximity with the photoconductor;

said first generator means having a first polarity to deposit excess ions on the surface of said photoconductor during the first cycle, and charging a transfer media during a second cycle, a second generator means operably associated with said photoconductor;

said second generator means having a second polarity opposite to that of the first to smooth/reduce the excess ions on the surface of the photoconductor during said first cycle;

image means operably associated with the photoconductor to image a latent print of a document onto said photoconductor;

developer means operably associated with said photoconductor for developing the latent print;

transfer media operably associated with the photoconductor to transfer the latent print from the photoconductor to said media during the second cycle; and cleaning means operable during the second cycle for cleaning the surface of said photoconductor.

16. An electrostatic copying apparatus for performing a series of copying functions including charging for charging a photosensitive layer, exposure for forming an electrostatic latent image corresponding to the pattern of an original on the charged photosensitive layer, development for turning the electrostatic latent image formed on the photosensitive layer to a visible image, transfer for transferring the visible image formed on the photosensitive layer to a copying paper, and cleaning for cleaning the photosensitive layer after the transfer; the copying apparatus comprising:

a rotatable drum on the circumferential surface of which the photosensitive layer is formed and which makes two rotations for performing the series of the copying functions;

a charging transfer combination unit for charging the photosensitive layer in the first rotation of the rotatable drum and performing transfer in the second rotation, said combination unit facing the photosensitive layer of the rotatable drum;

an exposure unit performing the exposure function and facing the photosensitive layer of the rotatable drum;

a development unit performing the development function and facing the photosensitive layer of the rotatable drum, and;

a cleaning unit performing the cleaning function and facing the photosensitive layer of the rotatable drum.

17. An electrostatic copying apparatus according to claim 16 wherein the charging transfer combination unit comprises a corona discharge device discharging corona of the same polarity and potential for both the charging and transfer functions.

18. An electrostatic copying apparatus for performing a series of copying functions including at least charging for charging a photosensitive layer, exposure for forming an electrostatic latent image corresponding to the pattern of an original on the charged photosensitive layer, development for turning the electrostatic latent image formed on the photosensitive layer to a visible image, transfer for transferring the visible image formed on the photosensitive layer onto a copying paper, eliminating the electrostatic latent image after the tansfer and cleaning for cleaning the photosensitive layer after the elimination of the latent image; the copying apparatus comprising:

a rotatable drum on the circumferential surface of which the photosensitive layer is formed and which makes two rotations for performing the series of the copying functions;

a charging transfer combination unit including means impressed with a voltage of a predetermined level for performing the charging in the first rotation of the rotatable drum and the transfer in the second rotation, said charging transfer combination unit facing the photosensitive layer of the rotatable drum, an exposure unit performing the exposure in the first rotation of the rotatable drum and facing the photosensitive layer of the rotatable drum;

a unit discharging the photosensitive layer for eliminating the electrostatic latent image after the transfer, and;

a development cleaning combination unit including means for receiving developing powder and means for forming an electromagnetic brush for performing the development in the first rotation of the rotatable drum and the cleaning in the second rotation, said development cleaning combination unit facing the photosensitive layer of the rotatable drum.

19. An electrostatic copying apparatus according to claim 18 wherein the charging transfer combination unit comprises a corona discharge device discharging corona of the same polarity and potential for both the charging and transfer functions.

20. An electrostatic copying apparatus according to claim 18 wherein the development cleaning combination unit comprises a magnetic roller disposed adjacent to the photosensitive layer of the rotatable drum and impressed with a low bias voltage in the development step and with a high bias voltage in the cleaning step to form a magnetic brush.

21. An electrostatic copying apparatus for performing a series of copying functions including at least charging of a photosensitive layer, exposure for forming on the photosensitive layer an electrostatic latent image corresponding to the image of an original, development for turning the electrostatic latent image formed on the photosensitive layer to a visible image, transfer of the visible image formed on the photosensitive layer onto a copying paper, eliminating the electrostatic latent image after the transfer and cleaning of the photosensitive layer, the copying apparatus comprising:

a rotatable drum on the circumferential surface of which the photosensitive layer is formed and which makes two rotations for performing the series of the copying functions, a charging transfer combination unit having means impressed with a voltage of a predetermined level for performing the charging in the first rotation of the rotatable drum and the transfer in the second rotation, said charging transfer combination unit facing the photosensitive layer of the rotatable drum, and an exposure and electrostatic latent image eliminating unit having optical means for performing the exposure in the first rotation of the rotatable drum to form the latent image on the rotatable drum and means for directing light to the photosensitive layer to eliminate the latent image of the photosensitive layer after the transfer in the second rotation of the rotatable drum, said exposure electrostatic latent image eliminating unit facing the photosensitive layer of the rotatable drum and a development cleaning combination unit including means for attaching toner to the electrostatic latent image for the development purpose in the first rotation of the rotatable drum and for electrostatically pulling the residual toner attached to the photosensitive layer for the cleaning purpose after the elimination of the latent image in the second rotation of the rotatable drum, said development cleaning combination unit facing the photosensitive layer of the rotatable drum.

22. An electrostatic copying apparatus according to claim 21, wherein the development cleaning combination unit comprises a magnetic roller disposed adjacent to the photosensitive layer of the rotatable drum and impressed with a low bias voltage in the development step and with a high bias voltage in the cleaning step to provide a magnetic brush.

23. An electrostatic copying apparatus according to claim 21, wherein the charging transfer combination unit comprises a corona discharge device discharging corona of the same polarity and potential for both the charging and transfer functions.

24. The apparatus as claimed in claim 21, further including means for illuminating the photoconductor so as to erase said photoconductor during the second cycle.

25. In a two cycle process electrophotographic apparatus having a photoconductor which is charged, imaged, developed during a first cycle of the two cycle process, transferred and cleaned during a second cycle of said two cycle process, the improvement comprising in combination:

a first charging means positioned in proximity with the photoconductor;

said first charging means being operable for charging the photoconductor during the first cycle of the two cycle process and for charging a transfer media during the second cycle of said two cycle process;

image means, operably associated with the photoconductor, to deposit a latent image of a document onto said photoconductor;

developing means operably associated with the photoconductor to develop the latent image;

transfer media operably associated with the photoconductor to transfer the latent image from the photoconductor to said media; and means operable for cleaning the photoconductor.

26. An electrophotographic apparatus comprising:

a photoconductive drum having a surface and making at least two rotations during a series of copying processes;

a first charging device for charging the surface of said photoconductive drum in one polarity during a first rotation of said photoconductive drum;

a first exposing device for exposing said photoconductive drum in order to form on the surface of said drum an electrostatic latent image corresponding to an original image pattern;

a developing device for visualizing the latent image during the first rotation of said drum comprising a magnetic brush unit supplied with a bias voltage of the one polarity and feeding toner charged in the other polarity opposite to the polarity of the latent image to form a toner image;

said first charging device being impressed with a voltage of the one polarity and operating as a transferring unit for transferring the toner image formed by said developing device to a copy sheet during the second rotation of said drum;

a second exposing device for exposing the entire surface of said drum; and a second charging device for charging in the other polarity the residual toner charged in the one polarity in the image by said first charging device so that said magnetic brush unit electrically attracts the residual toner charged in the other polarity by said second charging device during the second rotation of said drum in order to clean said drum.

* * * * *

UNITED STATES PATENT AND TRADEMARK OFFICE

CERTIFICATE OF CORRECTION

PATENT NO. : 4,432,631

DATED : February 21, 1984

INVENTOR(S) : J. L. Bacon and G. L. Smith

It is certified that error appears in the above—identified patent and that said Letters Patent is hereby corrected as shown below:

Column 3, line 4, "heat" should read --best--.
Column 4, line 50, "23" should read --22--; line 65, "20" should read --28--.
Column 5, line 7, "most" should read --next--; line 12, "3,637,906" should read --3,637,306--.

Signed and Sealed this

*Eighth* Day of *May 1984*

[SEAL]

*Attest:*

GERALD J. MOSSINGHOFF

*Attesting Officer*

*Commissioner of Patents and Trademarks*